United States Patent [19]

Wong et al.

[11] 4,443,152

[45] Apr. 17, 1984

[54] AXIAL SLURRY PUMP

[75] Inventors: George S. Wong, Agoura; Fritz C. Catterfeld, Canoga Park; Clifford A. Hauenstein, Woodland Hills, all of Calif.

[73] Assignee: Rockwell International Corporation, El Segundo, Calif.

[21] Appl. No.: 23,801

[22] Filed: Mar. 26, 1979

Related U.S. Application Data

[63] Continuation-in-part of Ser. No. 838,609, Oct. 3, 1977, abandoned.

[51] Int. Cl.[3] ..... F04D 29/18

[52] U.S. Cl. ..... 415/143; 415/199.5; 415/215; 416/188

[58] Field of Search ..... 415/199.1, 199.4, 199.5, 415/199.6, 72, 143, 215; 416/188

[56] References Cited

U.S. PATENT DOCUMENTS

| | | | |
|---|---|---|---|
| 1,654,975 | 1/1928 | Kapuczin | 415/72 UX |
| 2,030,560 | 2/1936 | Adams | 415/72 UX |
| 2,332,614 | 10/1943 | Swearingen | 415/112 |
| 2,378,372 | 6/1945 | Whittle | 415/199.5 X |
| 2,463,976 | 3/1949 | Kilchenmann | 416/188 |
| 2,500,745 | 3/1950 | Bloomberg | 415/212 X |
| 2,604,257 | 7/1952 | Church et al. | 415/112 |
| 2,984,189 | 5/1961 | Jekat | 415/143 X |
| 3,090,703 | 5/1963 | Gruber et al. | 415/200 X |
| 3,155,044 | 11/1964 | Lattanzio et al. | 415/199.6 X |
| 3,163,119 | 12/1964 | Huppert et al. | 415/72 |
| 3,213,798 | 10/1965 | Carswill | 415/112 X |
| 3,522,997 | 8/1970 | Rylewski | 415/143 X |
| 3,588,280 | 6/1971 | Yedidiah | 415/143 X |
| 3,608,976 | 9/1971 | Zugelder | 415/212 X |
| 3,723,019 | 3/1973 | Berman | 415/143 X |
| 3,734,649 | 5/1973 | Sandy, Jr. | 415/143 X |
| 3,951,565 | 4/1976 | Rothe et al. | 415/72 X |

FOREIGN PATENT DOCUMENTS

| | | | |
|---|---|---|---|
| 29522 | of 1906 | United Kingdom | 415/199.5 |
| 26586 | of 1909 | United Kingdom | 415/72 |
| 546503 | 7/1942 | United Kingdom | 415/199.5 |
| 1218023 | 1/1971 | United Kingdom | 415/143 |

*Primary Examiner*—Leonard E. Smith

*Attorney, Agent, or Firm*—H. Fredrick Hamann; Harry B. Field

[57] ABSTRACT

A multi-section inline axial flow pump is designed to pump a large volume of liquids containing solids in suspension. The pump consists essentially of a tandem-blade row, high-head axial inducer, a ten-stage low-pressure section and a ten-stage high-pressure section driven by one or more externally connected electric motors.

4 Claims, 9 Drawing Figures

Fig. 4a
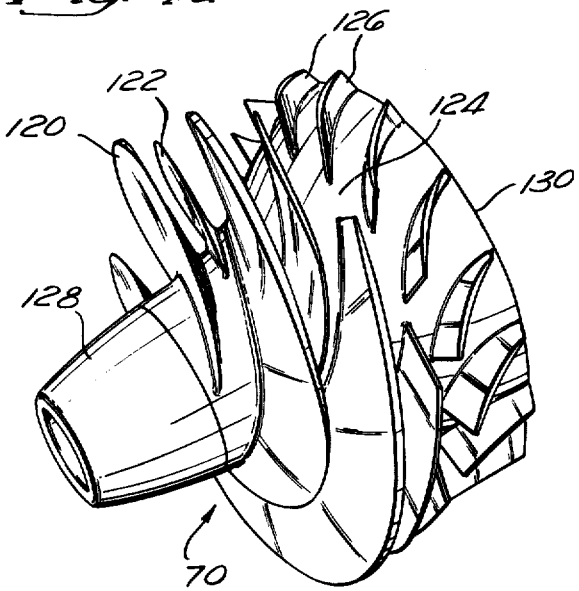
Fig. 4c
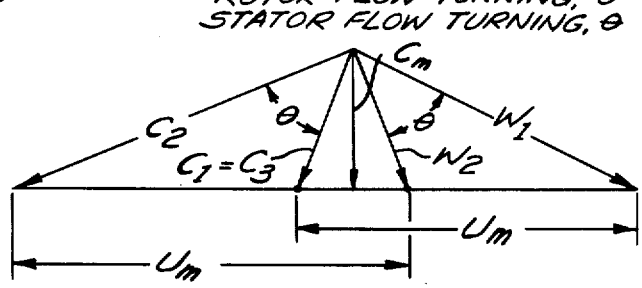
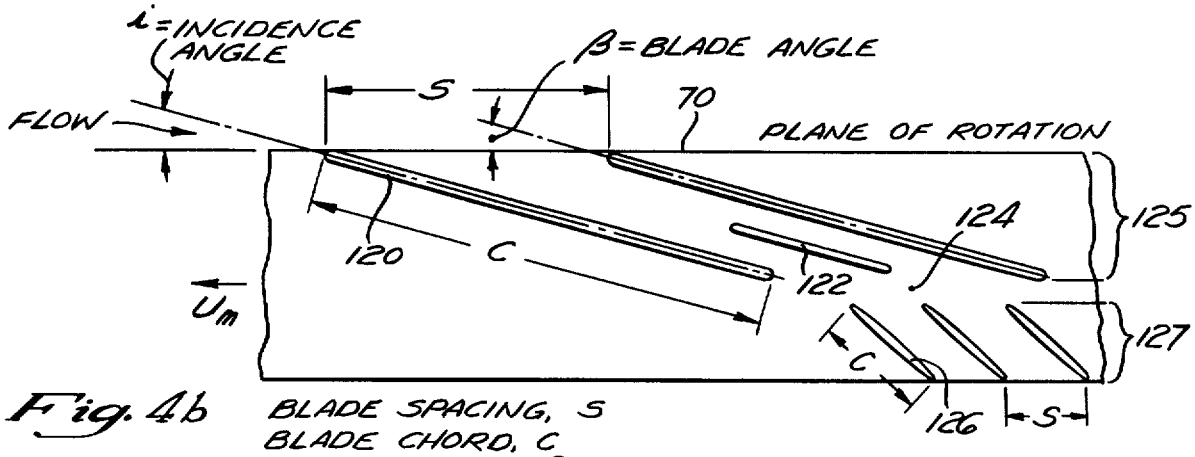
Fig. 4b
BLADE SPACING, S
BLADE CHORD, C
SOLIDITY, $\sigma = \frac{C}{S}$
Fig. 4d
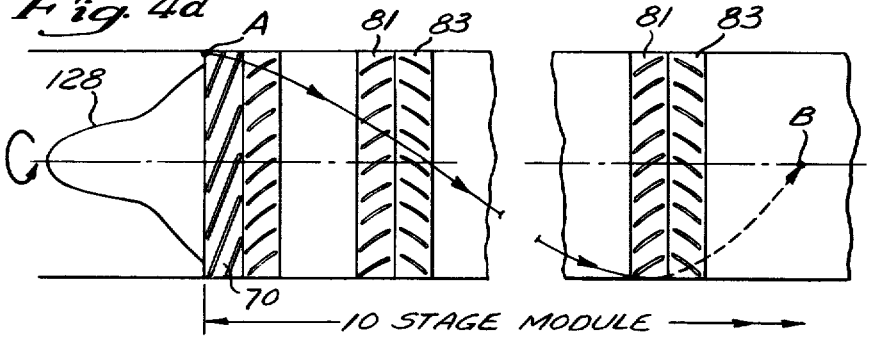
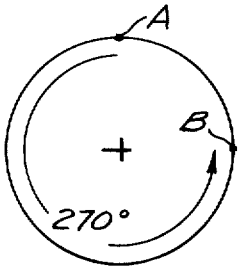
Fig. 4e

AXIAL SLURRY PUMP

CROSS-REFERENCE TO RELATED APPLICATION

This application is a Continuation-In-Part of copending application Ser. No. 838,609 filed Oct. 3, 1977, and abandoned on March 26, 1979.

BACKGROUND OF THE INVENTION

1. Field of the Invention

This invention relates to the field of hydraulic transportation of coal or mineral slurries in large pipelines at high pressures over long distances.

More particularly, this invention relates to the transportation of coal slurries by the utilization of an inline, high efficiency axial flow pump in large pipelines at high pressures and over long distances.

2. Description of the Prior Art

A recent state-of-the-art search relative to slurry pumps did not disclose the use of an axial flow pump for transporting liquids containing solids in suspension.

Most pipeline slurry pump operations utilize either displacement pumps of the reciprocating type or centrifugal pumps. State-of-the-art piston pumps are of the high pressure, low capacity variety and multiple pumps in parallel are required, particularly where a large tonnage of coal is hydraulically transported through large pipelines to meet current energy demands. It is estimated 25 to 30 million tons of coal will be needed annually in the very near future.

A multiplicity in series of state-of-the-art moderate capacity, low pressure centrifugal pumps would be required to meet the needs heretofore mentioned.

The piston pump, then, is disadvantaged in that while it may be a high pressure pump it is low capacity; consequently, many in parallel are required to transport high volume slurries over long distances. Additionally, heavy duty piston pumps are very large in size and complex to incorporate into an existing pipeline.

The centrifugal pumps are disadvantaged in that while they have a moderate capacity they are generally low in pressure; thus, many are required in a series relationship to transport large volume slurries over long distances.

The present invention teaches the use of an axial slurry pump having high capacity, high pressure and a relatively small size that is positioned in line with an existing pipeline for efficient hydraulic transport of coal slurries and the like for long distances from remote mining areas to primary and secondary user stations, such as electric power, synthetic fuel and chemical plants. An axial pump concept is highly suited for pumping liquids containing solids in suspension, such as coal and mineral slurries. Since it characteristically has the highest flow rate per unit inlet flow area of any pump type, it will, therefore, have the smallest pump diameter for a given flow rate. The axial pump has the highest hydraulic efficiency of any bladed rotary pump because of its straightforward and simple hydraulic flow geometry which produces minimum flow losses.

SUMMARY OF THE INVENTION

An axial flow pump for the transportation of liquids containing solids consists essentially of an elbow inlet pipe connected to an elongated cylindrical conduit housing. A drive shaft is positioned concentrically within the cylindrical conduit, the drive shaft entering the conduit through a first bearing/seal drive shaft support assembly mounted to an outside wall formed by the elbow inlet pipe. An upstream, tandem-blade inducer section and at least one low-pressure rotor/stator section, are mounted on the concentric drive shaft within the cylindrical conduit. Additionally, at least one high-pressure rotor/stator section can optionally be mounted on the drive shaft with a center water lubricated drive shaft support bearing mounted between the low and high-pressure rotor/stator sections. This drive shaft support bearing is supported by the cylindrical housing. A downstream pintle body section is mounted on the drive shaft to enhance hydraulic flow prior to the fluid reaching the elbow outlet which is connected to the cylindrical conduit housing. The drive shaft concentrically positioned within the housing exits through a wall portion formed by the elbow outlet pipe. The drive shaft is supported by a second bearing/seal assembly mounted exteriorally of the wall, and a drive means is connected to the drive shaft to rotate the axial flow pump.

The compact, high capacity axial pump is designed, for example, for a large 1000-mile long, 38-inch diameter coal slurry pipeline with a throughput of about 18,000 gpm. Twelve axial pumps would be required over the total length of the pipeline. The pump is comprised of an inducer, a ten-stage low-pressure section, and a ten-stage high-pressure section developing an overall pressure of 1000 psi. The staging in the pump is completely internal, extremely compact and simple. The pump is driven by, for example, a 11,500 horsepower electric motor at about 600 rpm, through a shaft in the inlet elbow of the pump housing. The pump may also be driven from both the inlet and outlet elbow segments with separate motors. An additional pump section may be added for higher pressure demand. Efficiencies above 90 percent are characteristic for axial pumps of this design.

It is an object of this invention to provide an inline axial flow pump for a large pipeline for the transportation of liquids containing solids in a slurry at high pressure and at high capacity over long distances.

An advantage over prior art piston pumps for transportation of slurries is the large capacity, small size of the axial pump as compared to piston pumps. The present axial pump replaces a multiplicity of piston pumps.

An advantage over the prior art centrifugal pumps is the high-pressure capability of the multi-stage inline axial pump as compared to the moderate capacity low-pressure centrifugal pumps.

Still another advantage over both the piston pumps and the centrifugal pumps is the ability of the axial pump to increase the pressure of the slurry as it progresses through the multi-stage axial pump.

The above-noted objects and advantages of the present invention will be more fully understood upon a study of the following detailed description in conjunction with the detailed drawings.

BRIEF DESCRIPTION OF THE DRAWINGS

FIG. 4*a* is a prospectus view of the tandem-blade row inducer;

FIG. 4*b* is a diagrammatical side view of the tandem-blade row inducer;

FIG. 4*c* is a symmetrical velocity diagram for the axial flow pump;

FIG. 4*d* is a diagrammatical representation of the path of a solid particle through ten stages of an axial pump;

FIG. 4*e* is a cross-section of FIG. 4*d;* and

DESCRIPTION OF THE PREFERRED EMBODIMENTS

Figure 1:
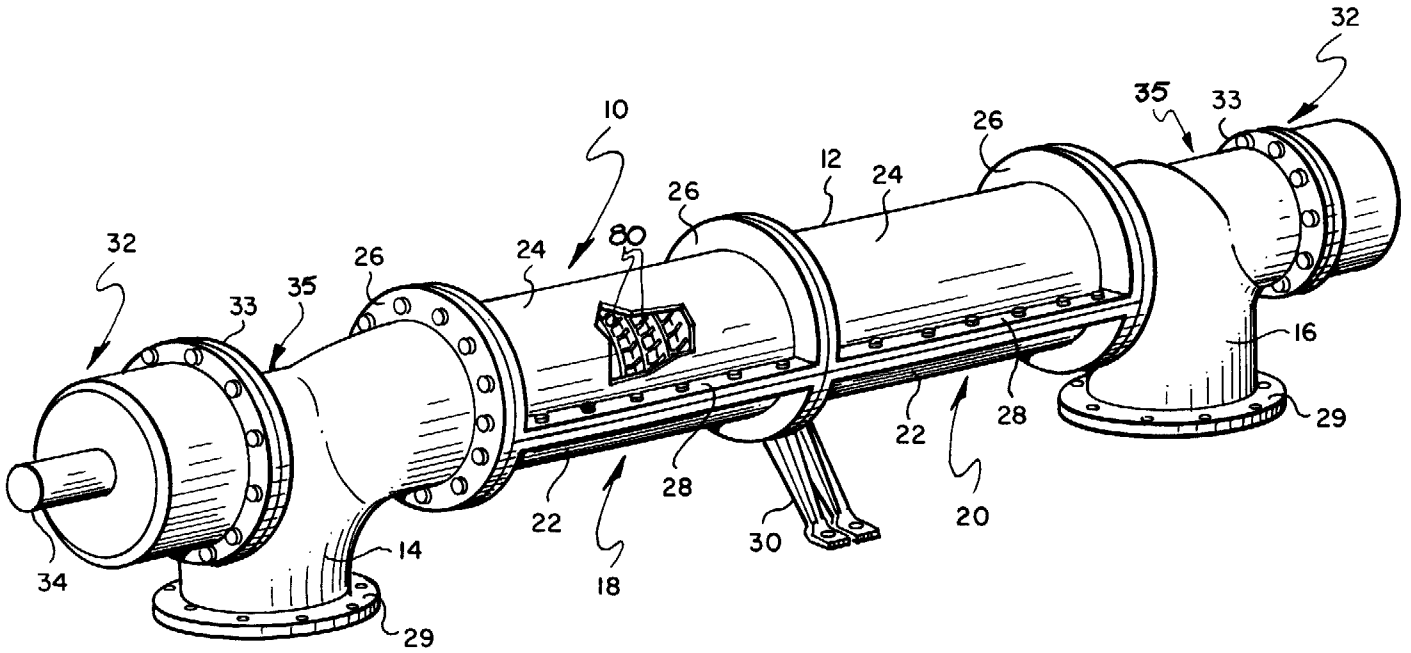
FIG. 1 is a perspective view of an axial slurry pump.

Referring to FIG. 1, there is shown the axial slurry pump 10 comprised of a pump housing 12 having a pump inlet elbow 14 and a pump outlet elbow 16 connected at either end of the pump. In the preferred configuration, the pump housing 12 comprises a low-pressure pump section 18 and a high-pressure pump section 20. The low and high-pressure pump segments are supported at the middle radially extending flange 26 and by pump support legs 30. Each pump section 18 and 20 is comprised of split shell halves 22 and 24. The shell halves are separated along longitudinal flanges 28 and around radially extending flanges 26.

The inducer plus a twenty-stage/two-section axial pump 10 is normally driven, for example, through the inlet elbow 14 by shaft 34. Shaft 34 connects to any drive means such as an electric motor. Shaft 34 is supported through a bearing assembly 32. The bearing assembly 32 connects to a seal housing 35 which contains a double mechanical seal assembly therein. At the opposite end of the two-section axial pump is an identical bearing assembly 32 and seal housing 35 to support the opposite end of the axial pump. Another embodiment of the invention drives the axial pump from both ends of the pump housing whereby an electric motor is connected at both the inlet and the outlet end of the pump (not shown).

Figure 2:
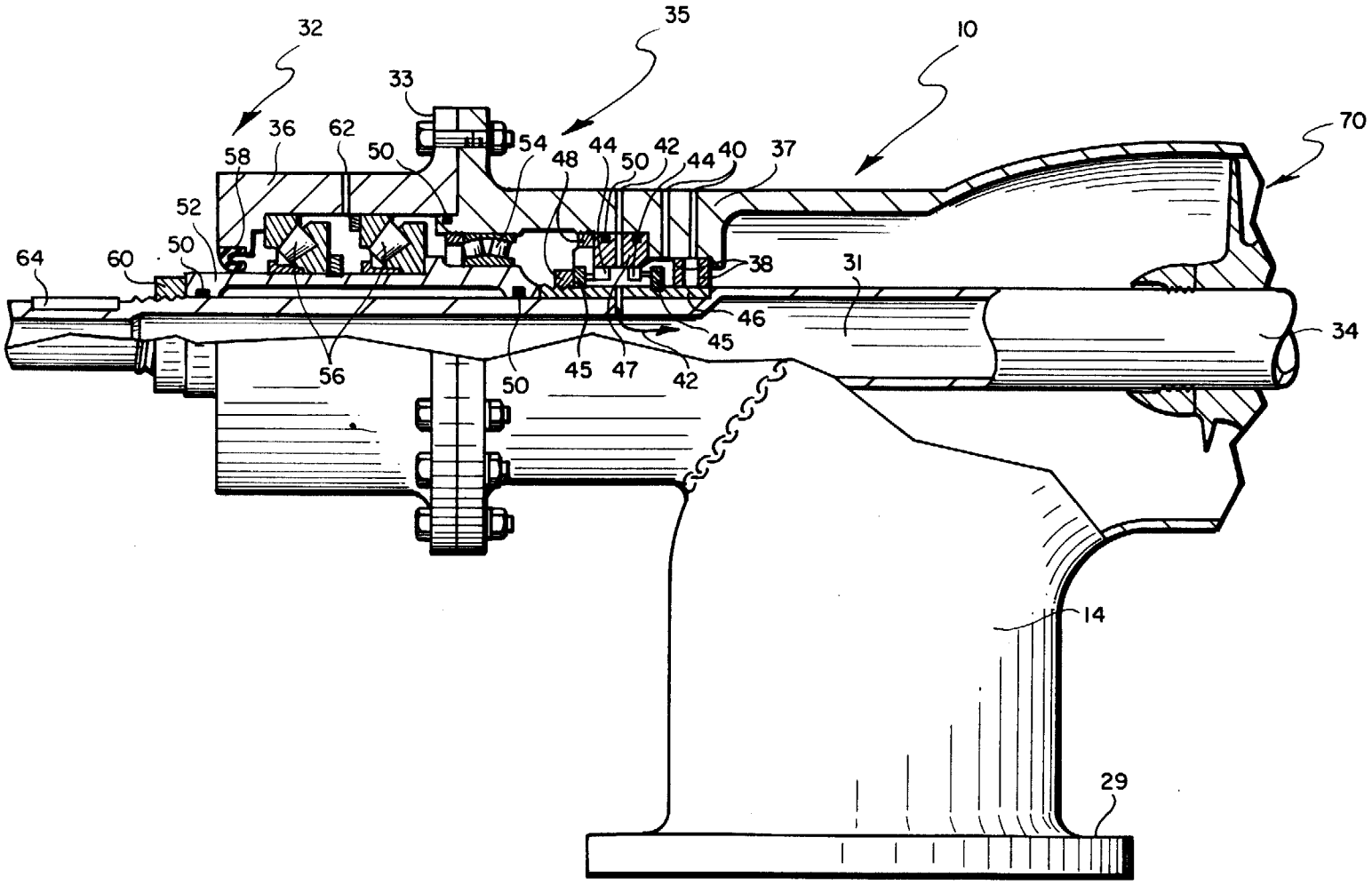
FIG. 2 is a partially broken-away cross-section of the inlet portion of the axial flow slurry pump illustrating a double mechanical seal assembly and a bearing assembly.

Details of the axial slurry pump are illustrated in FIG. 2. Shaft 34 is coupled to the electric motor (not shown) by keyway 64. The bearing assembly 32 contains a pair of identical bearings 56 which are designed to transmit axial loads on shaft 34. The bearings 56 are lubricated via oil inlet 62. The inner race of bearings 56 is connected to sleeve 52, while the outer race is in contact with housing 36 of bearing assembly 32. A seal 58 prevents oil leakage past sleeve 52. The bearing assembly 32 is connected to the double mechanical seal assembly in a housing section generally designated as 35 by flange 33. The seal assembly in housing section 35 is comprised of a pair of tungsten carbide rings 38 which serve as an initial barrier to the incoming slurry material through elbow 14 in the pipeline configuration. Following each set of tungsten carbide rings, drain cavities 40 allow the material leaking through gap between the rings to pass out through the drains. A pair of spring-loaded seals 44 are positioned inwardly of the tungsten carbide rings. The faces of the spring seals 44 ride on rings 45, the rings 45 and the tungsten carbide rings 38 ride on or connect to a sleeve 46 which is locked to shaft 34 by nut 48. Also, the spring seal mechanisms are connected to ring 47 which, in turn, is locked within the housing 37 by nut 48. A fresh water inlet orifice 42 supplies fresh water or "clear" water to the spring-loaded seals 44 and also to the interior manifold 31 within shaft 34. The clear water serves to flush out any slurry material that gets past the tungsten carbide rings. The hollow shaft 34 serves as a conduit to supply clear water to the pump rotor downstream of the inlet elbow 14.

Figure 3:
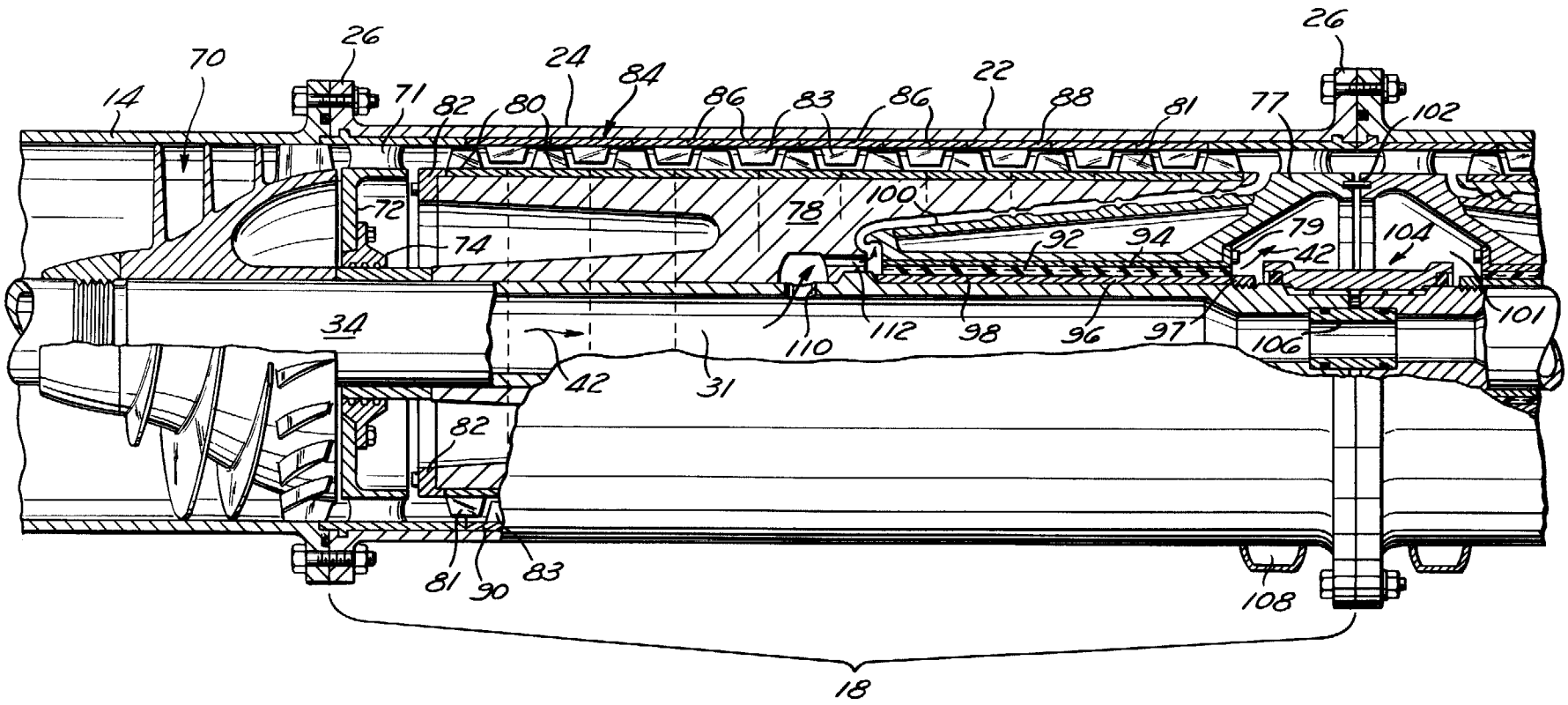
FIG. 3 is a cross-section continuation of FIG. 2 illustrating the inducer inlet section and the low-pressure section and a portion of the high-pressure section downstream of the low-pressure section.

Turning now to FIG. 3, a continuation of FIG. 2, the shaft 34 initially drives a tandem-blade row, high-head axial inducer section 70. Downstream of the inducer 70 is the low-pressure multi-stage section 18 of the axial flow pump 10. Between the rotor 78 and the inducer 70 is a support 72 which contains a static type seal 74. The support 72 serves to provide a stator to guide the slurry moving past the inducer 70 into the low pressure pump section 18. A series of guide vanes 71 make up the stator section of the inducer and guide the slurry into the first stage of the low-pressure axial pump 10. The rotor 78 of low-pressure axial pump section 18 is supported downstream of the inducer by a water-lubricated aft bearing 92. The water bearing 92 is contained in sleeve portion 94. The water-lubricated aft bearing has a series of longitudinally extending grooves in a rubber-like material, the grooves serving to provide a passageway for the clear water lubricant that passes therethrough. The passageway, or conduit 31, within the rotor drive shaft 34 directs water into one or more orifices 110, through orifice 112, and down through the grooves 98 into cavity 101 formed by housing 77 where it is collected within the lube water return sump 108. Clear water is additionally directed through the tortuous passageway 100 between the rotor support housing 77 and the rotor 78. The tortuous clear water passageway 100 serves to prevent slurry material from getting into the water-lubricated aft bearing. The clear water bleeds into the slurry passageway between the outer housing wall and the rotor 78. By maintaining the pressure of the clear water within drive shaft 34 higher than the pressure of the slurry moving through the pump, the abrasive slurry will be discouraged from getting into the various bearing assemblies.

A sleeve 96 is retained on the outer surface of shaft 34 by a nut 97. The sleeve is coated with, for example, a ceramic-type material that provides a high degree of resistance to the abrasive qualities of the pipeline slurry material. The water-lubricated aft bearing is contained in sleeve 94 which is retained within the shaft support section 77, the sleeve 94 being retained to the shaft support section 77 by bolt 79.

The rotor spool 78 supports a series of circumferentially mounted rotor blade segment rings 80. Each rotor blade segment ring 80 on the rotor spool represents one-half of a stage of the low-pressure axial flow pump section 18. Each rotor blade segment ring 80 comprises a ring containing a multiplicity of radially extending blades 81. The rotor blade ring segments 80 on the rotor are retained with end cap 82 which is connected to the rotor housing 78. The second element of each stage comprises a stator segment 86 having a multiplicity of inwardly radially extending blades 83 which co-act with each of the rotor blade ring segments 80.

The low or high-pressure sections, for example, may be dismantled by removing the flange bolts from flanges 26 and 28 (FIG. 1), thus, the upper segment 24 may be removed from the low or high-pressure segments, thereby exposing the stator section. The stator section, in turn, for example, could be removed from the pump assembly by splitting the stator segment in half much like the pump housing 24 so that the stator section half 88 could be lifted out, in turn exposing the entire rotor assembly for ease of maintenance. The lower half of the stator 90 remains in the bottom half 22 of the pump housing. The stator lower half 90 could be rotated out of the lower half for maintenance. The housing, then, of the axial slurry pump is comprised of an outer housing shell 24, an inner stator shell concentrically positioned therein generally designated as 84, the stator section containing all of the inwardly extending stator blades 83 attached to rings 86 (not shown) contained within stator upper and lower shells 88 and 90.

The low-pressure section containing ten stages is coupled to an identical high-pressure section (not shown), the high-pressure section being connected by a transfer sleeve 108 and a drive coupling 104 contained within housing 77. A slurry seal 102 prevents ingress of abrasive slurry material within the clear water cavity 101 formed by housing 77.

Turning to FIG. 4*a* there is shown the tandem-blade row, high-head, axial inducer 70 for the axial pump 10. This axial inducer 70 is designed to provide a substantial high-pressure to the low-pressure portion 18 of the axial pump 10. The inducer is formed by a low hub ratio ($\xi$), high solidity ($\sigma$), first blade row, and a high hub ratio ($\xi$), low solidity ($\sigma$), second blade row. This is more clearly shown in FIG. 4*b* wherein there is a diagrammatical representation of the tandem-blade row, high-head, axial inducer 70. The axial inducer 70 is followed by a stator blade row 71 which, combined with the axial inducer 70, forms the inlet stage for the axial pump 10. In the preferred embodiment, the first blade row section of the inducer comprises four full blades 120 and four partial blades 122. The four full blades 120 have a high tip solidity of about three, a flat blade angle $\beta$, relative to the plane of rotation, of about 10° and operates at an incidence angle of about 4°. It should be noted that the blade angle variation from inducer hub to the tip varies according to r(tangent $\beta$)=a constant, wherein r is the radius. The partial blades 122 divide the flow passage area of the four full blades 120 equally, increase the pressure developed by the first blade row section, and develop a radially uniform meridional velocity distribution at the discharge 124 or inlet to the second blade row. The first blade row is designed to develop about 40% of the pressure developed by the inducer stage. The second blade row of the inducer 70 comprises 16 blades 126, and develops about 60% of the pressure developed by the inducer 70. It should be additionally noted that the second blade row generates a free-vortex, radial distribution of tangential velocity at the inducer discharge. It should also be noted that although the preferred blade construction of the first blade row is four full blades and four partial blades, and the preferred blade construction of the second blade row is 16 blades, the particular design requirements are dictated by the individual needs of the individual pumping situations, and thus the number of blades is not as critical as the fact that there are two blade rows in the inducer. The inducer hub 128 is frustoconical in geometry and forms a converging flow section from the axial pump inlet to inducer discharge. The inducer inlet hub ratio, which is the hub radius divided by the tip radius, is about 0.40. The hub ratio at the discharge is about 0.85 and the meridional velocity, which is $C_m$, increases by about 5 times as a consequence of these factors. The stator 71, located at the inducer discharge 130, provides the free-vortex radial distribution of tangential velocity and the higher flow coefficient, as inlet conditions to the first axial stage of the multi-stage pump. This inlet condition will be kept constant and repeated in all subsequent axial stages of the multi-stage pump. The inducer 70 is designed for gradual rotation of the flow, to generate pressure, and to gradually increase the meridional velocity to reduce erosive wear by the slurry. The inducer blades 120, 122, and 126 are also designed for full-radius, rounded leading edge operating at low fluid incidence angle for maximum wear life.

Each axial stage within the multi-stage pump 10 comprises a constant, high hub ratio ($\xi$) of about 0.85 for rotors 81 and stators 83. All the axial stages in the pump are of identical design and each develops about a 50 psi pressure rise. The tip speed ($U_m$) of the rotor is about 75 ft/sec, which is equal to the current state-of-the-art in centrifugal slurry pumps. No axial flow slurry pump exists which generates this tip speed. Each axial stage is designed for a symmetrical velocity diagram as shown in FIG. 4*c*. At the mean radius there is an equal static pressure rise across the rotor and stator, and a uniform distribution of head along the blade radius. This results in a constant value of meridional velocity from the root to the tip of the rotor and stator blades, and constant meridional velocity through every stage in the pump. The symmetrical velocity diagram FIG. 4*c* and constant meridional velocity produces uniform axial distribution of pressure rise through the pump, identical pump and hub tip diameters, and the lowest flow velocity at both the tip and root of both rotor and stator blades.

The axial flow pump is designed for gradual fluid rotation with no severe streamline curvatures that will cause solid particles to diverge from streamline flow and impinge on flow surfaces. In the ten-stage axial pump section, the solid particles enter the pump inducer 70, leave the tenth axial stage and will have rotated, or spiraled through the pump only about three-fourths around the circumference of the pump, FIGS. 4*d* and 4*e*. The short flow path through the pump results in less erosive wear of the pump internal components and casing, and thus increases pump life.

Figure 5:
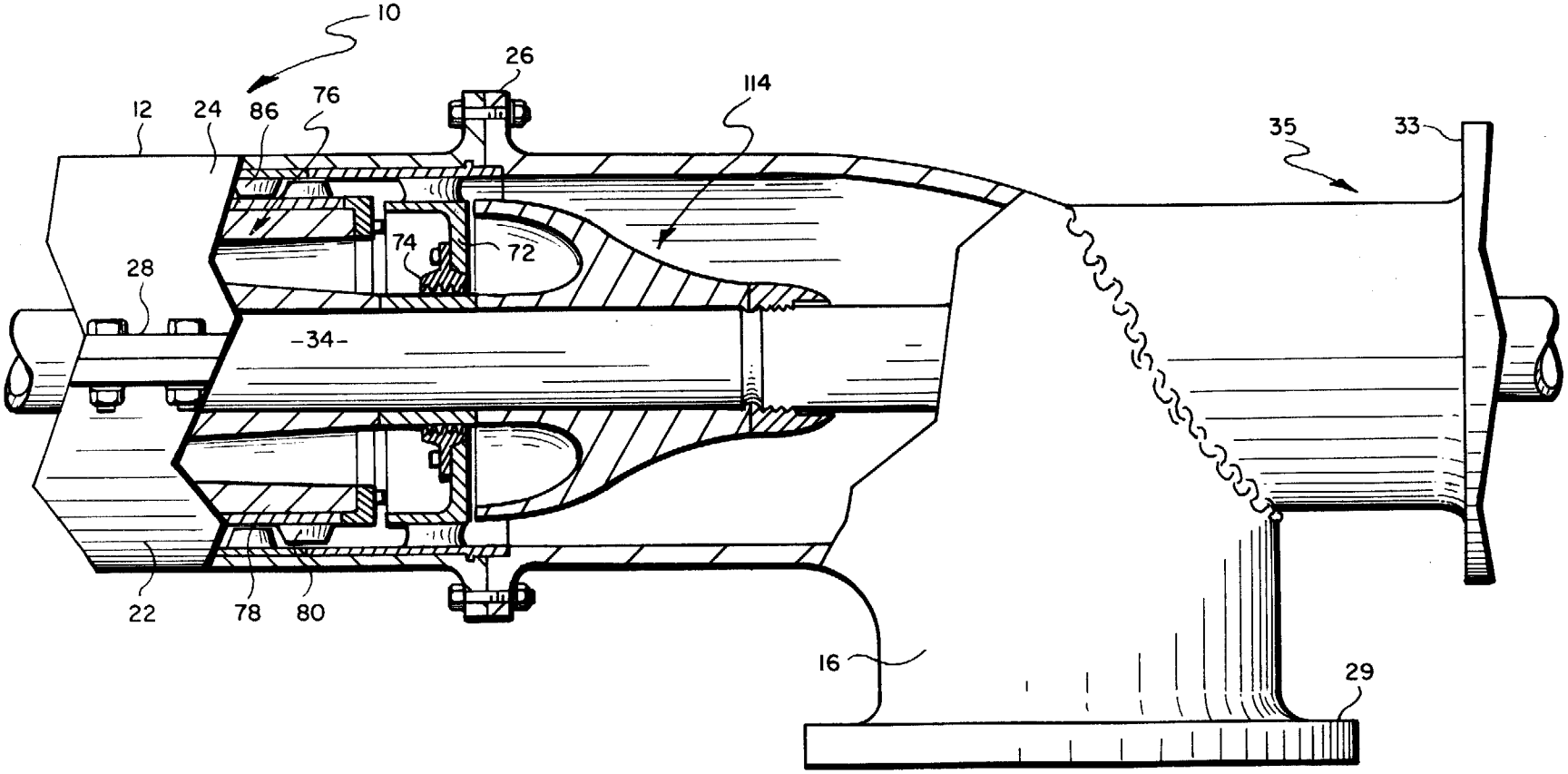
FIG. 5 is a cross-section continuation of FIG. 3 illustrating the end of the high-pressure pump section and the outlet elbow of the pump.

Referring now to FIG. 5, there is illustrated the pintle body section 114. The pintle body 114 is located at the end of the high-pressure section and directs the accelerated slurry through pump outlet 16.

During pump operation, clear water is brought into the double mechanical seal assembly 35 through the interior manifold or conduit formed by the shaft 34 into the water-lubricated aft bearing through opening 101 and conduit 112, the clear water then flowing through the conduit groove 98 within the water-lubricated bearing 92 into the cavity 101 formed by housing 77, the water then drains into the lube water return sump 108 to be recycled back through the double mechanical seal assembly for reuse. The slurry material passing through the low and high-pressure pump sections is discouraged from entering the aft and forward bearing 92 by providing clear water at a positive pressure through the conduit 100, a small amount of clear water will enter the stream of the slurry material as it passes through the tortuous path 100. Thus, it can readily be seen that the abrasive slurry material is prevented from entering the bearing assembly of the rotor 78.

The back-to-back axial pumps, then, containing a low-pressure stage and a high-pressure stage develop approximately 1000 psi. Each of the twenty stages in this example develops approximately 50 psi. An axial slurry pump developing these kinds of pressures could, for example, be mated to a 38-inch diameter coal slurry pipeline slurry pump having a throughput of approximately 18,000 gpm. The staging, of course, in the pump is completely internal and the pump is driven, for example, by a drive means developing approximately 11,500 horsepower. The pump motor rotates at approximately 600 rpm. Of course, the pump may also be driven from both the inlet elbow 14 and the outlet elbow segment 16 (FIG. 1) and each drive means on opposite ends of the pump housing then develops approximately 6000 horsepower, turning at about 600 rpm.

It is apparent, then, that the pump is highly flexible whereby the pump housings may be dismantled quickly and easily, each of the pump sections being repairable with a minimum of time. One of the other of the pump segments may be removed and replaced without removing the entire pump housing assembly from the pipeline operation. In addition, where the replaceable rotor blades are mounted on separate rings, any and all stages of the rotor assembly may be replaced for repair. The stator housing may be split in halves so that the rotor is easily accessible to the repairman, plus each of the inwardly extending stator blades may be easily replaced.

Another embodiment might include a feature wherein each blade and each ring is separately replaceable so that rather than replace each ring of the staged axial pump each blade may be replaced individually within either the stator rings or the rotor rings, thus making the repair of the pump even more accessible and easy to do. Of course, the blades may be fabricated from a number of abrasion-resistant materials such as, for example, tungsten carbide, matrix composites, stellites, etc.

Internal pump passages such as the inlet and outlet elbows and the stator housing sections are protected against abrasion erosion by the deposition of hard materials on the wetted surfaces, for example, stellite hardfacing, tungsten carbide, vapor deposition, and boriding.

It will, of course, be realized that various modifications can be made in the design and operation of the present invention without departing from the spirit thereof. Thus, while the principal, preferred construction, and mode of operation of the invention have been explained and what is now considered to represent its best embodiment has been illustrated and described, it should be understood that within the scope of the appended claims the invention may be practiced otherwise than as specifically illustrated and described.

We claim:

1. An axial flow pump for the transportation of liquids containing solids wherein said axial flow pump comprises a cylindrical conduit housing a concentrically positioned drive shaft and at least one pressure stage having a rotor and a stator coaxially positioned along said drive shaft and wherein the improvement comprises an inducer stage comprising:

a tandem-blade row inducer coaxially mounted on said drive shaft, and wherein said tandem-blade row inducer comprises a first blade row having blades of low hub ratio and high solidity, a first blade row discharge zone, and a second blade row having blades of high hub ratio and low solidity; and an inducer stage stator, hydraulically matched to accept the output of said tandem-blade row inducer, to diffuse and turn the flow discharge in the direction of rotation of the succeeding rotor rotation thereby reducing relative inlet velocity, and to establish the same inlet flow conditions for each succeeding pump stage.

2. The axial pump of claim 1 further comprising at least one low-pressure stage and at least one downstream high-pressure stage.

3. The axial pump of claim 2 wherein said low-pressure section and said high-pressure section comprises twenty stages, each stage developing about 50 psi, said axial flow pump developing about 1000 psi.

4. The axial pump of claim 1 wherein the flow rate through said pump is about 18,000 gpm.

* * * * *